US006131718A

United States Patent [19]

Witschorik

[11] Patent Number: 6,131,718

[45] Date of Patent: Oct. 17, 2000

[54] SYSTEM AND METHOD FOR THE DETECTION OF COUNTERFEIT CURRENCY

[75] Inventor: Charles Arthur Witschorik, Naperville, Ill.

[73] Assignee: Lucent Technologies Inc., Murray Hill, N.J.

[21] Appl. No.: 09/163,517

[22] Filed: Sep. 30, 1998

[51] Int. Cl.[7] ..... G07D 7/04

[52] U.S. Cl. ..... 194/206; 235/382.5

[58] Field of Search ..... 194/206, 207, 194/210; 235/381, 382.5

[56] References Cited

U.S. PATENT DOCUMENTS

| | | | |
|---|---|---|---|
| 3,774,743 | 11/1973 | Henderickson | 194/210 |
| 5,255,129 | 10/1993 | Jones | 235/449 |
| 5,557,516 | 9/1996 | Hogan | 364/406 |
| 5,607,040 | 3/1997 | Mathurin, Sr. | 194/207 |
| 5,889,271 | 3/1999 | Webb | 235/472.01 X |

*Primary Examiner*—F. J. Bartuska
*Attorney, Agent, or Firm*—Walter W. Duft

[57] ABSTRACT

A system and method for detecting counterfeit currency are disclosed wherein a currency bill encoded with security data is scanned by a currency scanning terminal placed at a currency exchange location such as a store or a bank. The security data can include the currency bill's serial number and a corresponding code number, and is preferably magnetically encoded on a magnetic medium affixed to or embedded in the bill. The currency scanning terminal reads the security data and transmits it via a communications link to a programmable security computer. The security computer responds to receipt of the security data by comparing the transmitted security data with previously stored security data and generating a comparison result. If the comparison result is true, the security computer calculates an updated security code, stores the updated security code in the data store, and transmits the updated security code to the currency scanning terminal. The currency scanning terminal then writes the updated security data to the currency bill and generates a validation message. If the comparison result is false, the security computer invalidates the currency bill in the data store and transmits a rejection code to the currency scanning terminal. The currency scanning terminal then writes the rejection code to the currency bill and generates a rejection message. Because each currency bill must have valid security data stored in the data store, and because the security data is updated each time the currency bill is exchanged, counterfeiting is rendered virtually impossible.

21 Claims, 3 Drawing Sheets

SYSTEM AND METHOD FOR THE DETECTION OF COUNTERFEIT CURRENCY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to a security system and method for detecting counterfeit currency wherein security data encoded on articles of currency is compared with pre-stored security data in order to authenticate the currency during commercial transactions. If the comparison is true, the security data is dynamically updated and the currency is validated. If the comparison is false, the security data is invalidated and the currency is rejected.

2. Description of the Prior Art

The production of counterfeit currency is a problem that has grown dramatically in recent years. This increase is attributable, in large part, to the advent of color photocopy machines in the early 1990s, and the subsequent introduction of low cost color ink jet printers around 1994–1995. In 1997 alone, it is estimated that at least $30 million in counterfeit money was passed domestically, and this figure is expected to grow in the years ahead.

Existing technologies developed to address the counterfeiting problem include complicated embossing and microprinting techniques, and the use of optical scanners capable of detecting minute variances in currency features, such as printing pattern, color and sheet stock material. The principal deficiency of these existing anti-counterfeiting measures is that they rely on a person or device to identify variations between the features of a counterfeit bill and those of an authentic bill. Whether or not such comparisons are successful depends upon the sophistication of the counterfeiter and the capabilities of the counterfeit detection system. If the counterfeiter is able to reproduce a currency bill within some range of authenticity deemed acceptable by the detection equipment, the bill will go undetected and the counterfeiter will prevail. The result is that the government must develop more sophisticated detection equipment, which is inevitably followed by upgrades in the counterfeiter's methods and techniques. The problem of detection is thus never fully solved, and new detection devices with greater sensitivity must continually be sought.

It will be appreciated in light of the foregoing that there is a need in the art for a counterfeit currency detection system that does not rely on the feature detection schemes of the past. What is required is a new approach that implements a different and greatly improved technique for currency validation.

BRIEF SUMMARY OF THE INVENTION

In accordance with the present invention, an improved security system and method for detecting counterfeit currency are provided wherein a currency bill is encoded with security data that is verified and dynamically updated each time the bill is processed by the system during commercial transactions. In the preferred embodiment, the security system comprises a centralized, programmable security computer which communicates with a plurality of currency scanning terminals placed at currency exchange locations such as stores, banks and the like. Each currency scanning terminal is configured for both reading and writing security data on a currency bill.

The security data can include the currency bill's serial number and a corresponding security code number, such that each bill is doubly-encoded. The security data is preferably magnetically encoded on a magnetic medium, such as a strip or disk, affixed to the bill, or a magnetic thread or the like that is embedded into the bill to form a magnetically encodable area. Optical or magneto-optical encoding could also be used. When the currency bill is presented for exchange, the bill is scanned through the scanning terminal, which reads the security data and transmits it via a communications link, which could be part of a public or private telephone network, computer data network, or any other connection-based or connectionless telecommunications system, to the security computer. The security computer maintains a data store containing security data for all currency that is in active circulation.

The security computer responds to receipt of the security data by comparing the transmitted security data with the security data stored in the data store and generating a comparison result. If the comparison result is true, the security computer calculates an updated security code, stores the updated security code in the data store, and transmits the updated security code to the currency scanning terminal. For example, if the currency bill is doubly encoded with the currency bill's serial number and a corresponding security code number, a new security code number is randomly generated by the security computer and associated with the existing serial number. Following receipt of the updated security data, the currency scanning terminal writes the data to the currency bill and generates a validation message indicating that the bill is authentic. If the comparison result is false, the security computer invalidates the currency bill in the data store and transmits a rejection code to the currency scanning terminal. The rejection code is written to the currency bill and a rejection message is generated indicating that the bill is not authentic. Because each currency bill must have valid security data stored in the security computer's data store in order to be authenticated, and because the security data is updated each time the bill is exchanged, counterfeiting is rendered virtually impossible.

BRIEF DESCRIPTION OF THE SEVERAL VIEWS OF THE DRAWING

The foregoing and other features and advantages of the invention will be apparent from the following more particular description of a preferred embodiment of the invention, as illustrated in the accompanying Drawing, in which.

DETAILED DESCRIPTION OF THE INVENTION

Figure 1:
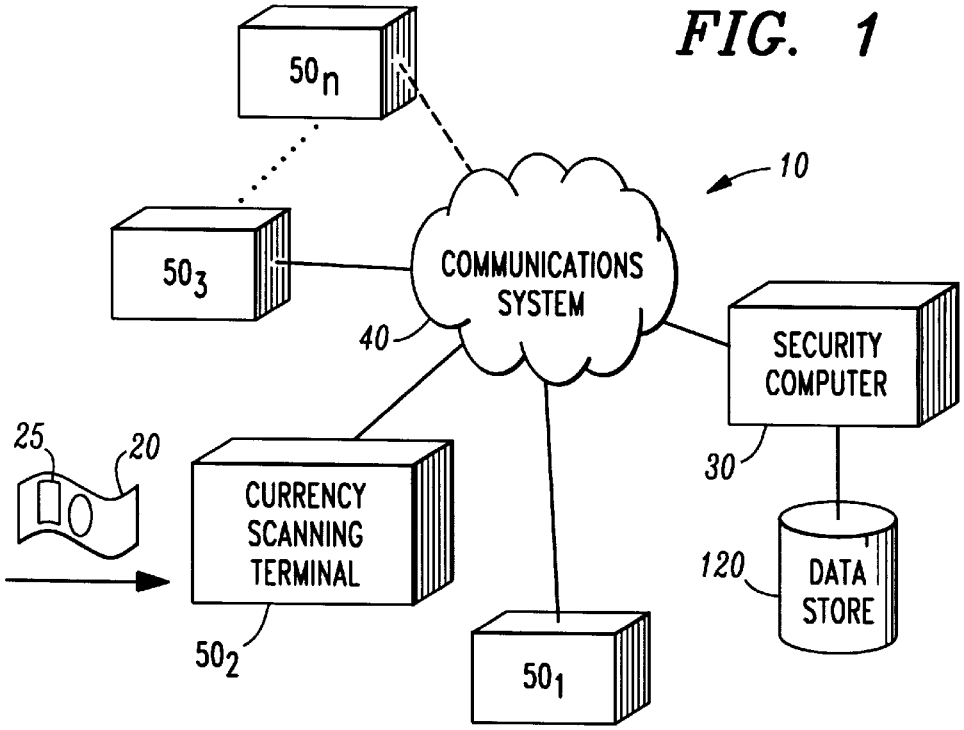
FIG. 1 is a three-dimensional block diagram showing a security system constructed in accordance with the preferred embodiment of the invention.

Turning now to the Drawing, wherein like reference numbers designate like elements in all of the several views, FIG. 1 illustrates a security system 10 constructed in accordance with the present invention. The security system 10 is adapted for authenticating currency bills 20, each of which has an information area 25 encoded with unique, machine-readable security data. The security system 10 utilizes a programmable security computer 30 to process currency authentication requests submitted over a communications system 40 by a plurality of currency scanning terminals $\mathbf{50}_1$, $\mathbf{50}_2$, $\mathbf{50}_3$ . . . $\mathbf{50}_n$ (hereinafter referred to as "50"). The terminals 50 may be placed at currency exchange locations such as stores, banks or other locations where counterfeit currency detection is desired. As described in more detail below, when an authentication request is made, the security computer 30 advises the inquiring terminal as to currency authenticity, and the terminal takes responsive action.

Apart from the information area 25, each currency bill 20 is a conventional article of paper currency produced in any suitable denomination by a governmental entity. The information area 25 may be formed from any medium that allows data read/write operations to be performed thereon. The principal consideration is that each currency bill 20 be capable of storing its security data in a manner that allows the security data to be automatically scanned and dynamically updated each time the bill is processed by the security system 10.

Figure 2A:
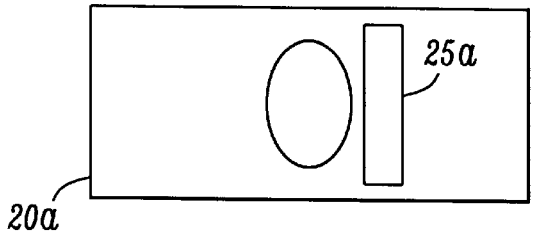
FIG. 2*a* is a diagrammatic plan view of a currency bill having a machine-readable data storage strip mounted thereon.

FIGS. 2*a,* 2*b* and 2*c* illustrate three exemplary currency bills 20*a,* 20*b* and 20*c,* respectively. The currency bills 20*a,* 20*b* and 20*c* each have an information area, shown by reference numbers 25*a,* 25*b* and 25*c,* respectively, that is encoded with machine-readable security data in accordance with the present invention. The information areas 25*a,* 25*b* and 25*c,* which are described in more detail below, can be encoded using magnetic, optical or magneto-optical techniques, or any other suitable data recordation technology. For cost reasons, it is contemplated that the information areas 25*a,* 25*b* and 25*c* will preferably be magnetically encoded. However, because magnetic encoding is susceptible to erasure by strong magnetic fields, optical or magneto-optical encoding may provide a more desirable alternative, particularly as these technologies mature and become more attractive from a cost standpoint.

In FIG. 2*a,* the information area 25*a* is formed by a data storage strip that is affixed to the currency bill 20*a*. The strip can be made from any suitable material that is encodable in machine-readable form. For example, if magnetic encoding is used, the data storage strip of FIG. 2*a* could be a thin magnetic strip of the type found on credit cards, debit cards, security access cards, and the like. If optical or magneto-optical encoding is used, the data storage strip of FIG. 2*a* could be a thin strip of plastic material that is surface-treated using techniques presently employed to manufacture conventional optical or magneto-optical data storage disks. The data storage strip of FIG. 2*a* can be mounted on the currency bill 20*a* at any convenient location using any suitable technique, such as adhesive bonding. Typically, data would be encoded on the data storage strip of FIG. 2*a* in a linear pattern.

Figure 2B:
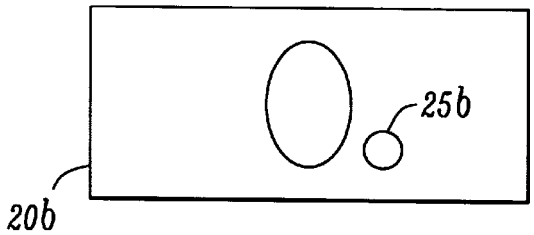
FIG. 2*b* is a diagrammatic plan view of a currency bill having a machine-readable data storage medium of circular shape mounted thereon.

In FIG. 2*b,* the information area 25*b* is formed by a circular data storage medium that is affixed to the bill 20*b*. This medium is similar in most respects to the data storage strip of FIG. 2*a,* except that it is smaller and less obtrusive. It can be encoded in the same manner as the data storage strip of FIG. 2*a,* but the recording may need to be at a higher data density due to the smaller footprint.

Figure 2C:
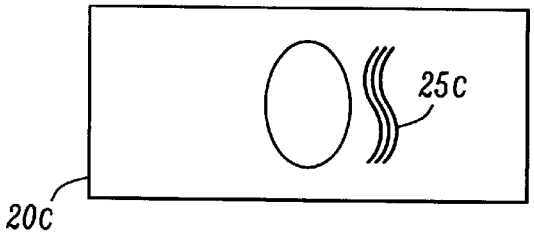
FIG. 2*c* is a diagrammatic plan view of a currency bill embedded with one or more machine-readable threads.

In FIG. 2*c,* the information area 25*c* is formed by one or more data storage threads that are embedded in the currency bill 20*c*. The data storage threads may be of any suitable size, shape and material, and can be embedded in the bill 20*c* at any convenient location using any suitable technique. For example, if magnetic encoding is used, the data storage threads of FIG. 2*c* could be filaments made from materials conventionally used to fabricate magnetically encodable wires, tapes and flexible disks. For optical and magneto-optical recording, the filaments could be made from materials conventionally used to fabricate optically or magneto-optically encodable disks, respectively. It is preferable, however, that such materials be processed so that the filaments are flexible in nature in order to prevent filament breakage as the currency is handled.

Figure 3:
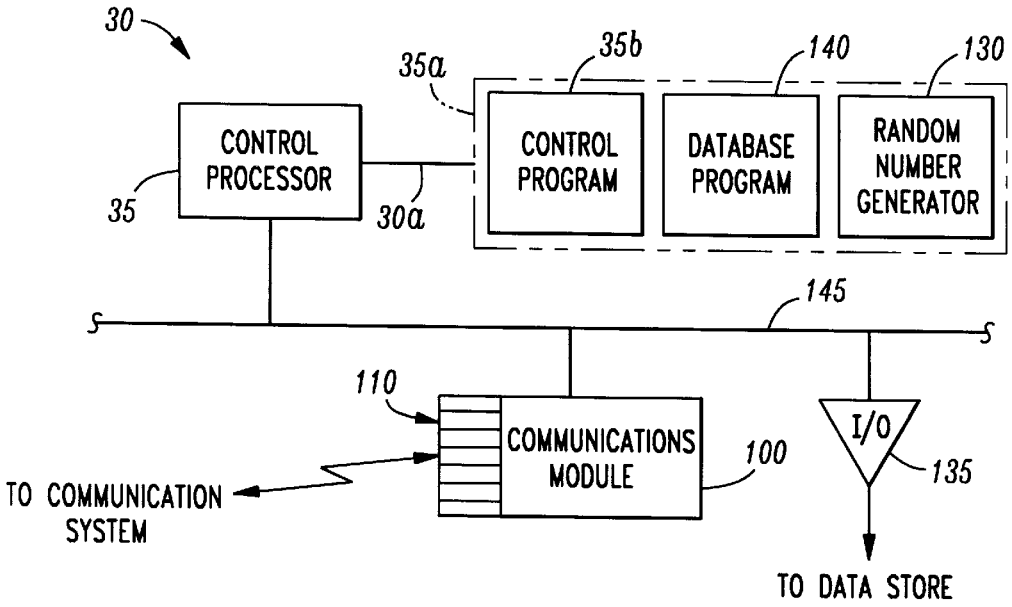
FIG. 3 is a block diagram showing the components of a security computer illustrated in FIG. 1.

Turning now to FIG. 3, the security computer 30 is preferably a general purpose data processing apparatus that is programmed to perform the currency authentication functions described herein. Any conventional mainframe, midrange or even smaller computer could be used, as could any combination or network of the foregoing, so long as the security computer 30 has sufficient processing power to handle large volumes of concurrent and sequential data processing and communication requests generated by the multiple currency scanning terminals 50. As shown in FIG. 3, the security computer 30 preferably includes, from a high level descriptive standpoint, a high-speed control and data bus 30*a* that provides communication between a control processor (CPU) 35 and a program memory 35*a* containing an executable control program 35*b*. The control program 35*b* could be written using any conventional high level programming language, such as C, Fortran, COBOL or the like, to provide a source code program which is compiled and linked into object code form, and then loaded into the program memory 30*a* for execution, preferably by an operating system. As noted, the control processor 35 and control program 35*a* function together to manage all of the security computer's currency authentication functions described herein.

Returning now to FIG. 1, the communications system 40 could be any public or private telephone network, a computer data network, or any other system implementing a connection-based or connectionless protocol to provide communications between the plural currency scanning terminals 50 and the security computer 30. The communications system 40 could be accessed using either dial-up or leased line connections.

Each currency scanning terminal 50 can be constructed in a variety of configurations using many of the components found in existing point-of-sale ("POS") terminals designed for credit card validation and the like. POS terminals have become relatively sophisticated in recent years and now provide a variety of functions to facilitate credit card sales transactions. Exemplary POS terminals integrate magnetic readers for reading credit card magnetic strips, barcode scanners for reading and automatically entering product codes, keyboards and keypads for entering additional transaction information, output display screens, receipt printers, and telephone and computer hookups for communication with remote computers.

Figure 4:
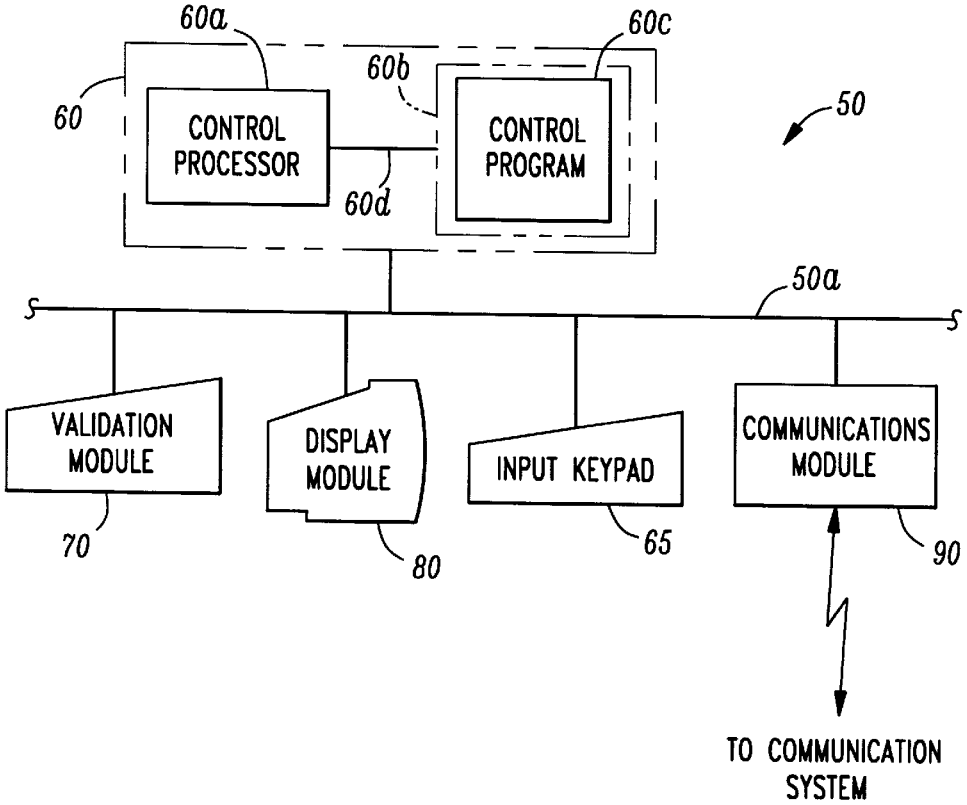
FIG. 4 is a block diagram showing the components of a currency scanning terminal illustrated in FIG. 1.

Turning now to FIG. 4, each currency scanning terminal 50 preferably includes, from a high level descriptive standpoint, a control and data bus 50*a* providing communication between a control module 60, an optional input keypad (or keyboard) 65, a validation module 70, a message display module 80, and a communications module 90.

The control module 60 can be constructed using hardwired logic components, or as described in more detail below, a programmed data processing system having a control processor (CPU) 60*a,* a memory 60*b* containing a control program 60*c,* and a control and data bus 60*d.* The control processor 60*a* can be implemented using any conventional programmable data processing device, such as a microprocessor, having sufficient processing power to control the operations of the currency scanning terminal 50. The memory 60*b* may be formed using random access memory (RAM), read-only memory (ROM), a suitable species of programmable read only memory (PROM), or any combination of the foregoing. The control program 60*c* may be implemented as software or firmware. It could be written in any suitable high level programming language, such as C, or in assembly language, to create a source code program that is compiled, linked and stored in executable object code form in the memory 60*b.* In combination, the control processor 60*a* and the control program 60*c* manage all of the operations of the currency scanning terminal 50 described herein.

The validation module 70 reads and writes security data on the currency bill 20 and may be constructed using any conventional magnetic, optical or magneto-optical read/write device. The validation module may also optionally include a currency feed mechanism, such as the type used in automated teller machines, for ease of operator use. The message display module 80 generates output messages to a user. It can be implemented using any suitable display device that is capable of displaying alpha-numeric messages. The communications module 90 communicates with the security computer 30 over the communications system 40. It can be implemented using any of a variety of conventional telecommunications network access devices, depending on the nature of the communications system 40 and the desired mode of access thereto. Such devices include modems, digital end point connection devices (e.g. T1, ISDN, DSL, ATM or Frame Relay connection equipment), network interface cards, and cellular telephones or other radio frequency transceivers employing time division or spread spectrum (e.g., code division) multiplexing. Advantageously, the use of a cellular telephone would allow the currency scanning terminal 50 to function as a portable device. Although not shown, the currency scanning terminal may also include a scanner for credit cards, debit cards, store cards or other monetary transaction cards, a bar code scanner, and any other components found on existing POS terminals. If a monetary transaction card scanner is added, the currency scanning terminal 50 would function as an integrated card and currency validation device, in which case both currency and monetary transaction cards could be authenticated. A stand alone card authentication apparatus could also be constructed using the validation techniques of the present invention.

Returning now to FIG. 3, the security computer 30 includes its own communications module 100, and this module may implement any of the technologies described above in connection with the communications module 90 in the currency scanning terminal 50. Unlike the communications module 90, however, the communications module 100 must provide multiple communication channels 110 so that the security computer 30 can, if necessary, service concurrent communication requests from the multiple currency scanning terminals 50.

The security computer maintains a data store 120, shown in FIG. 1, that preferably includes one or more direct access data storage (DASD) devices managed by the control program 35*b,* or by a conventional database software program 140 that receives input, such as SQL statements, from the control program 35*b.* The software program 140 could execute on the security computer 30, as shown in FIG. 3, or on a separate computer system (not shown), to manage the data store 120 as a single-node or multi-node (distributed) database.

The data store 120 contains security data for all currency that is in active circulation. In the preferred embodiment of the invention, the security data encoded on each currency bill includes the bill's serial number and a corresponding security code number. In this embodiment, the security data stored in the data store 120 would have the following format:

| Serial Number | Security Code Number |
|---|---|
| 12345 | 195897 |
| 12346 | 112209 |
| 12347 | 235490 |
| 12348 | 928654 |
| * | * |
| * | * |
| * | * |
| nnnnn | xxxxxx |

Each security code number is randomly generated and assigned to a currency bill serial number when the bill is issued into circulation by the government. The security data is encoded in the currency bill's information area 25 and stored in the data store 120. In order to generate the security code numbers, the security computer 30 includes a conventional pseudo-random number generating module 130, which could be implemented as a software program resident in the program memory 35*a,* or alternatively embodied in firmware or hardware. As shown in FIG. 3, an input/output device 135 is used to communicate with the data store 120. Depending on whether the data store 120 communicates directly with the security computer 30, or through its own computer (not shown), the input/output device 135 could be implemented using any suitable high speed data transfer protocol for communication between a computer and a storage device, or between two computers, respectively. The communications module 100 and the input/output device 135 communicate with the control processor 35 via a control and data bus 145.

Figure 5:
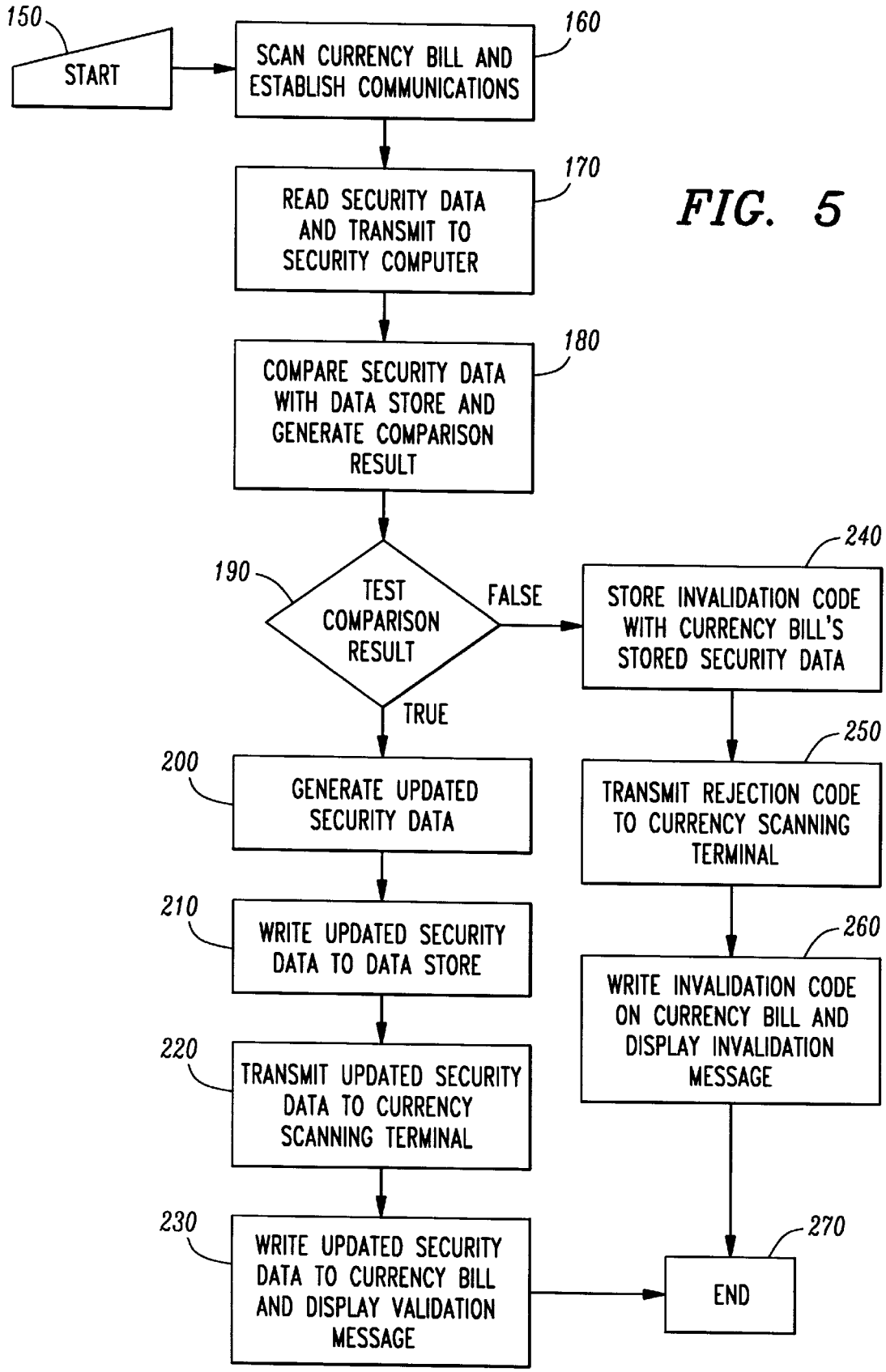
FIG. 5 is a flow chart showing a sequence of method steps performed by the security system of FIG. 1.

Turning now to FIG. 5, the method by which the security system 10 authenticates a currency bill 20, which includes steps separately performed by the security computer 30 and the currency scanning terminals 50, will be described. Beginning in step 150, an operator desiring to authenticate the currency bill 20 inserts the bill into one of the currency scanning terminals 50. In step 160, the validation module 70 responds to the insertion of the currency bill and performs a scan of the bill. Also during step 160, either prior to or after the bill is scanned, the communications module 90 establishes communication with the security computer 30, if such communication has not been previously established. In step 170, the validation module 70 reads the security data from the currency bill 20 and the communications module 90 transmits it via the communications system 40 to the security computer 30 using an appropriate protocol.

The security computer 30 receives the security data via one of the communication channels 110 of the communications module 100. In step 180, the security computer 30 responds to the receipt of the security data by comparing the transmitted security data with the security data stored in the data store 120. In the preferred embodiment of the invention wherein the security data includes the currency bill's serial number and a corresponding security code number, the comparison is performed by the security computer 30 first locating the bill's serial number in the data store 120, preferably using high speed database search techniques, and then comparing the corresponding security code number to the transmitted security code number. A comparison result is generated and stored at a temporary location in the memory 35*a*.

In step 190 of FIG. 5, the security computer 30 tests the comparison result. If the comparison result is true, indicating that the security code numbers match, the security computer 30 invokes the pseudo-random number generating module 130, in step 200 of FIG. 5, to randomly generate an updated security code number. In step 210, the new security code number is stored by the security computer 30 in the data store 120 in association with the existing serial number for the currency bill being processed. In step 220, the security computer transmits the updated security code to the currency scanning terminal 50, where it is received by the communications module 90. In step 230, following receipt of the updated security data, the validation module 70 of the currency scanning terminal 50 writes the updated security data to the currency bill 20, and the message display module 80 of the currency scanning terminal 50 generates a validation message indicating to the user that the currency bill 20 is authentic.

If the comparison result of step 190 is false, the security computer proceeds to step 240 and stores an invalidation code with the security data stored in the data store 120 for the currency bill being processed. Then, in step 250 of FIG. 5, a rejection code is transmitted to the currency scanning terminal 50. In step 260, the validation module 70 of the currency scanning terminal 50 writes the rejection code on the currency bill 20 so that the bill is rendered invalid for all future authentication attempts. In addition, the message display module 80 of the currency scanning terminal 50 generates a rejection message indicating that the currency bill 20 is not authentic. The transaction terminates in step 270 of FIG. 5.

Accordingly, a system and method for the detection of counterfeit currency have been described. In accordance with the invention, because each bill must have valid security data stored in the security computer's data store, and because the security data is updated each time the currency bill is exchanged, counterfeiting is made virtually impossible. Although a counterfeiter could potentially read security data from an authentic bill and encode it on a counterfeit bill, this is unlikely to occur because the authentic bill would be rendered invalid as soon as the counterfeit bill is exchanged and updated security data is generated. Conversely, if the authentic bill is exchanged before the counterfeit bill, the counterfeit is rendered invalid.

While various embodiments have been described, it should be apparent that many variations and alternative embodiments would be apparent to those skilled in the art in view of the disclosure herein. For example, although the security data of the preferred embodiment includes actual serial numbers, it would also be possible to encode serial numbers that are not the official serial numbers printed on the currency. Alternatively, the security system 20 could be adapted to encode only a security code number but not a serial number. In that case, the serial number could be scanned from the bill itself by conventional optical character recognition techniques. Incorporating an optical character recognition scanner into the currency scanning terminal 50 would also provide backup protection in the event that a bill's information is unreadable or communication cannot be established with the security computer 30.

It is also noted that the invention works best for currency that is regularly exchanged in commerce. There is a danger, albeit small, that if a bank or other entity stockpiled a quantity of currency, a dishonest employee or some other person could scan the security data and encode it onto counterfeit currency. Because the authentic currency is stockpiled, the counterfeit currency could potentially be circulated without detection. To eliminate this possibility, the security computer 30 could be programmed to "retire" selected currency by attaching an appropriate tag to the security data for such currency, or by transferring security data for such currency completely out of the data store 120 to an auxiliary storage system (not shown). If the currency is brought out of retirement, the security data could be returned to active status. Other information, such as date, time and location stamps, could also be added to the security data and used by the security computer 30 to monitor unusual currency exchange activity, or to trace stolen currency.

A further modification to the invention would be to periodically change the algorithm employed by the pseudo-random number generating module 130 for generating random security code numbers.

In light of the foregoing, it should be understood that the invention is not to be limited except in accordance with the spirit of the appended claims and their equivalents.

What is claimed is:

1. A system for detecting counterfeit currency, comprising:

a currency scanning terminal for reading and writing security data on a currency bill;

a programmable security computer;

a data store accessible by said security computer, said data store having stored therein a plurality of security data corresponding to a plurality of currency bills;

first communication means in said currency scanning terminal for communicating with said security computer;

second communication means in said security computer for communicating with said currency scanning terminal;

authorization request means in said currency scanning terminal responsive to a currency bill being scanned for reading said currency bill's security data and transmitting said security data to said security computer;

comparison means in said security computer responsive to receiving said security data transmitted by said currency scanning terminal for comparing said security data with said security data in said data store and generating a comparison result;

first validation means in said security computer responsive to said comparison result being true for calculating updated security data for said currency bill, storing said updated security data in said data store, and transmitting said updated security data to said currency scanning terminal;

first rejection means in said security computer responsive to said comparison result being false for invalidating said currency bill in said data store and transmitting a rejection code to said currency scanning terminal;

second validation means in said currency scanning terminal responsive to receiving said updated security data from said security computer for writing said currency bill with said updated security data and generating a validation message signifying that said currency bill is authentic; and second rejection means in said currency scanning terminal responsive to receiving said rejection code from said security computer for writing said currency bill with said rejection code and generating a rejection message signifying that said currency bill is not authentic.

2. A system in accordance with claim 1 wherein said security data comprises, for each of a plurality of currency bills, a currency bill serial number and a corresponding security code number.

3. A system in accordance with claim 1 wherein said first and second communication means include means for sending and receiving data over a telecommunications system.

4. A system in accordance with claim 1 wherein said first and second communication means include means for sending and receiving data over an analog telephone line.

5. A system in accordance with claim 1 wherein said first and second communications means include means for sending and receiving data over a digital telephone line.

6. A system in accordance with claim 1 wherein said first and second communications means include means for sending and receiving data over a cellular telephone system.

7. A system in accordance with claim 1 wherein said first and second communications means include means for sending and receiving data over a computer data network.

8. A system in accordance with claim 1 wherein said currency scanning terminal is adapted to read and write magnetic information on a magnetic storage medium affixed to or embedded in a currency bill.

9. A system in accordance claim 1 wherein said currency scanning terminal is adapted to read and write optical information on an optical storage medium affixed to or embedded in a currency bill.

10. A system in accordance with claim 1 wherein said currency scanning terminal is configured to read and write magneto-optical information on a magneto-optical storage medium affixed to or embedded in a currency bill.

11. A method for detecting counterfeit currency, comprising the steps of:

scanning a currency bill using a currency scanning terminal adapted for reading and writing security data on a currency bill;

prior to or after scanning said currency bill, establishing two-way communication between said currency scanning terminal and a programmable security computer that is connected to a data store having stored therein a plurality of security data corresponding to a plurality of currency bills;

transmitting security data read by said currency scanning terminal from said currency bill to said security computer;

comparing said security data transmitted by said currency scanning terminal with said security data stored in said data store and generating a comparison result;

if said comparison result is true, calculating updated security data for said currency bill, storing said updated security data in said data store, and transmitting said updated security data from said security computer to said currency scanning terminal;

if said comparison result is false, invalidating said currency bill in said data store and transmitting a rejection code from said security computer to said currency scanning terminal;

upon receipt of said updated security data at said currency scanning terminal, writing said currency bill with said updated security data and generating a validation message signifying that said currency bill is authentic; and upon receipt of said rejection code at said currency scanning terminal, writing said rejection code to said currency bill and generating a rejection message signifying that said currency bill is not authentic.

12. A method in accordance with claim 11 wherein said security data comprises, for each of a plurality of currency bills, a currency bill serial number and a corresponding security code number.

13. A method in accordance with claim 11 wherein two-way communication is established between currency scanning terminal and said security computer, at least in part, over a telecommunications system.

14. A method in accordance with claim 11 wherein two-way communication is established between currency scanning terminal and said security computer, at least in part, over an analog telephone line.

15. A method in accordance with claim 11 wherein two-way communication is established between currency scanning terminal and said security computer, at least in part, over a digital telephone line.

16. A method in accordance with claim 11 wherein two-way communication is established between currency scanning terminal and said security computer, at least in part, over a cellular telephone system.

17. A method in accordance with claim 11 wherein two-way communication is established between currency scanning terminal and said security computer, at least in part, over a computer data network.

18. A method in accordance with claim 11 wherein said currency scanning terminal is adapted to read and write magnetic information on a magnetic storage medium affixed to or embedded in a currency bill.

19. A method in accordance claim 11 wherein said currency scanning terminal is configured to read and write optical information on an optical storage medium affixed to or embedded in a currency bill.

20. A method in accordance with claim 11 wherein said currency scanning terminal is configured to read and write magneto-optical information on a magneto-optical storage medium affixed to or embedded in a currency bill.

21. A method for detecting counterfeit currency, comprising the steps of:

scanning an article of currency having security data encoded thereon in machine-readable and machine-writable form;

comparing said scanned security data with pre-stored security data corresponding to said currency article;

if the result of said comparison is true, updating said pre-stored security data, writing said updated security data on said currency article and generating a validation message; and if the result of said comparison is false, invalidating said pre-stored security data and said security data on said currency article and generating an invalidation message.

* * * * *